US007968788B2

(12) United States Patent
Shinjo et al.

(10) Patent No.: US 7,968,788 B2
(45) Date of Patent: Jun. 28, 2011

(54) ELECTRONIC KEYBOARD INSTRUMENT

(75) Inventors: Akiko Shinjo, Hamamatsu (JP); Hideki Ishihara, Jakarta (ID); Takashi Kato, Hamamatsu (JP); Takashi Fujita, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/640,632

(22) Filed: Dec. 17, 2009

(65) Prior Publication Data

US 2010/0147132 A1 Jun. 17, 2010

(30) Foreign Application Priority Data

Dec. 17, 2008 (JP) ..... 2008-320853

(51) Int. Cl.
*G10H 1/32* (2006.01)
*G10H 3/00* (2006.01)

(52) U.S. Cl. ..... 84/743; 84/13

(58) Field of Classification Search ..... 84/743, 84/13, 744

See application file for complete search history.

(56) References Cited

U.S. PATENT DOCUMENTS 6,392,136 B2 * 5/2002 Kondo et al. ..... 84/718
7,332,669 B2 * 2/2008 Shadd ..... 84/742
7,432,428 B2 * 10/2008 Kunisada et al. ..... 84/13
7,804,017 B2 * 9/2010 Hata et al. ..... 84/644
2001/0052284 A1 * 12/2001 Kondo et al. ..... 84/718
2003/0015086 A1 * 1/2003 Katz ..... 84/644
2007/0017353 A1 * 1/2007 Kunisada et al. ..... 84/723
2007/0028755 A1 2/2007 Suzuki
2009/0038469 A1 2/2009 Suzuki
2009/0241756 A1 * 10/2009 Tajima et al. ..... 84/604

FOREIGN PATENT DOCUMENTS

JP 2007-047273 A 2/2007

* cited by examiner

*Primary Examiner* — Jeffrey Donels
(74) *Attorney, Agent, or Firm* — Rossi, Kimms & McDowell LLP

(57) ABSTRACT

An electronic keyboard instrument in which the efficiency of sound emission is enhanced by preventing a soundboard portion having a large vibration amplitude from being hidden by a musical score plate to make sound emission of the soundboard to be hardly hindered by the musical score plate. A musical stand device is disposed rearward of a key-depression part of a keyboard and right above the soundboard, and has a musical score plate disposed close to and parallel to an upper surface of the soundboard when the musical score plate is in a fallen state. The soundboard is excited for sound production by transducers disposed on a lower surface of the soundboard. The transducers are disposed at positions where the transducers do not overlap, as viewed in plan, the musical score plate which is in the fallen state.

8 Claims, 9 Drawing Sheets

ELECTRONIC KEYBOARD INSTRUMENT

BACKGROUND OF THE INVENTION

1. Field of the Invention

The present invention relates to an electronic keyboard instrument that vibrates a soundboard to produce sounds.

2. Description of the Related Art

Conventionally, there has been known an electronic keyboard instrument having a vibration exciting unit disposed on a soundboard. When supplied with a musical tone signal, the vibration exciting unit vibrates the soundboard to produce sounds, as disclosed in Japanese Laid-open Patent Publication No. 2007-047273. In this keyboard instrument, the soundboard is disposed at a position rearward of a key-depression part of a keyboard and corresponding to a soundboard mounting position in a grand piano.

A keyboard instrument generally requires a music stand. Nevertheless, Japanese Laid-open Patent Publication No. 2007-047273 does not include a disclosure about a music stand. To mount a music stand on an electronic keyboard instrument having a soundboard, an optimum mounting position of the music stand must be considered.

SUMMARY OF THE INVENTION

The present invention provides an electronic keyboard instrument capable of enhancing the efficiency of sound emission by making sound emission of a soundboard to be hardly hindered by a musical score plate.

According to a first aspect of this invention, there is provided an electronic keyboard instrument comprising an instrument main body mounted with a keyboard, a music stand device having a musical score plate and disposed on the instrument main body at a location rearward of a key-depression part of the keyboard, a soundboard disposed on the instrument main body at a location downward of the musical score plate so as to face the musical score plate which is in a fallen state, a vibration exciting unit disposed on the soundboard and configured to excite the soundboard in accordance with a supplied musical tone signal to thereby produce sound by vibration of the soundboard, and a musical tone signal supply unit configured to supply the musical tone signal to the vibration exciting unit, wherein the vibration exciting unit is disposed at a position where the vibration exciting unit does not overlap, as viewed in plan, the musical score plate which is in the fallen state.

With this invention, the sound emission efficiency can be enhanced by preventing the soundboard, especially, a soundboard portion having a large vibration amplitude, from being hidden by the musical score plate to thereby make sound emission of the soundboard to be hardly hindered by the musical score plate.

The electronic keyboard instrument can include a lamp stand disposed on the instrument main body at a location rearward of the key-depression part of the keyboard and upward of the soundboard, and the vibration exciting unit can be disposed at a position where the vibration exciting unit does not overlap the lamp stand as viewed in plan.

In that case, the soundboard, especially, a soundboard portion having a large vibration amplitude, is prevented from being hidden by the musical score plate to thereby make sound emission of the soundboard to be hardly hindered by the lamp stand, whereby the sound emission efficiency can be enhanced.

The vibration exciting unit can be disposed at an intermediate position between the music stand device and the lamp stand as viewed in plan.

In that case, the sound emission efficiency can further be enhanced.

The lamp stand can be in a state where the lamp stand is out of contact with the soundboard, and can be fixed to said instrument main body in that state.

The electronic keyboard instrument can include a speaker assigned with a frequency band different from a frequency band assigned to the soundboard, and the speaker is disposed on the instrument main body at a location rearward of the soundboard or rearward of the music stand device.

According to a second aspect of this invention, there is provided an electronic keyboard instrument comprising an instrument main body mounted with a keyboard, a music stand device having a musical score plate and disposed on the instrument main body at a location rearward of a key-depression part of the keyboard, a soundboard disposed on the instrument main body on at least one of left and right sides of the music stand device, a vibration exciting unit disposed on the soundboard and configured to excite the soundboard in accordance with a supplied musical tone signal to thereby produce sound by vibration of the soundboard, and a musical tone signal supply unit configured to supply the musical tone signal to the vibration exciting unit.

With this invention, the soundboard is disposed at a position where the soundboard is not hidden by the musical score plate, to make sound emission of the soundboard to be hardly hindered by the musical score plate, whereby the sound emission efficiency can be enhanced.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1A:
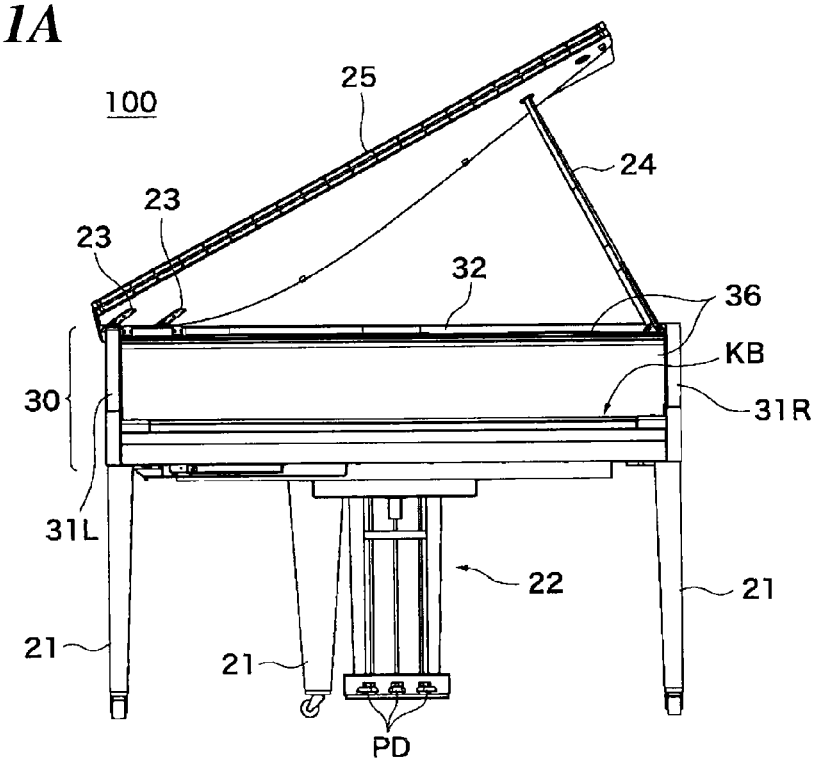
FIG. 1A is a front view of an electronic keyboard instrument according to one embodiment of this invention.
Figure 1B:
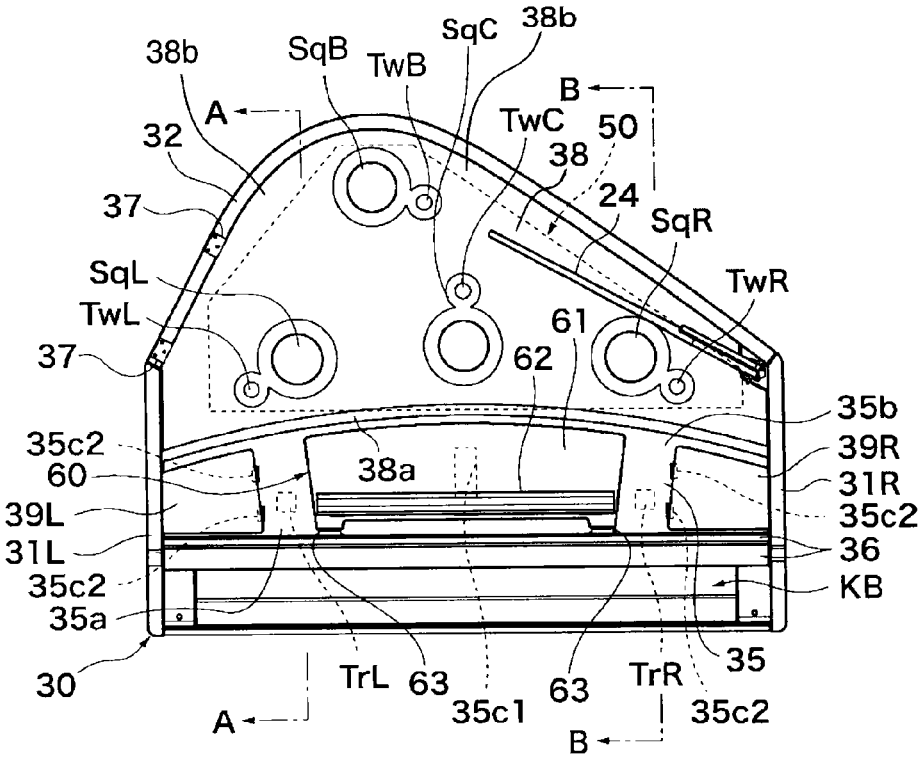
FIG. 1B is a plan view showing the electronic keyboard instrument in a state that a roof plate is detached therefrom.

FIG. 1A shows in front view an electronic keyboard instrument according to one embodiment of this invention. The electronic keyboard instrument 100 is provided at an upper part with an openable and closable roof plate 25, which is in an open state in FIG. 1A. FIG. 1B shows in plan view the keyboard instrument 100 in a state where the roof plate 25 is detached therefrom. In FIGS. 1A and 1B, a fallboard 36 that covers a keyboard KB is shown in an open state.

Figure 2:
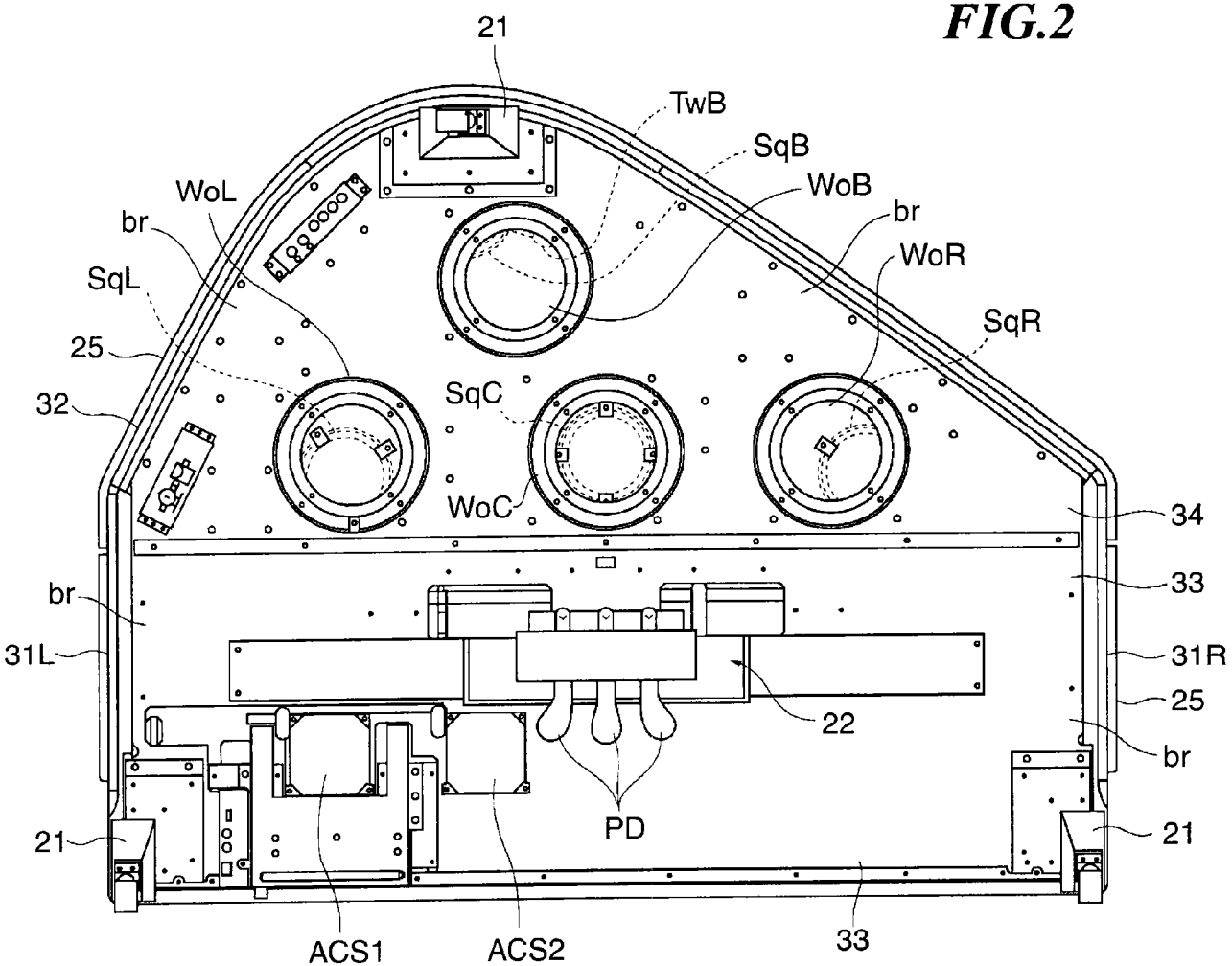
FIG. 2 is a bottom view of the electronic keyboard instrument.
Figures 3A, 3B:
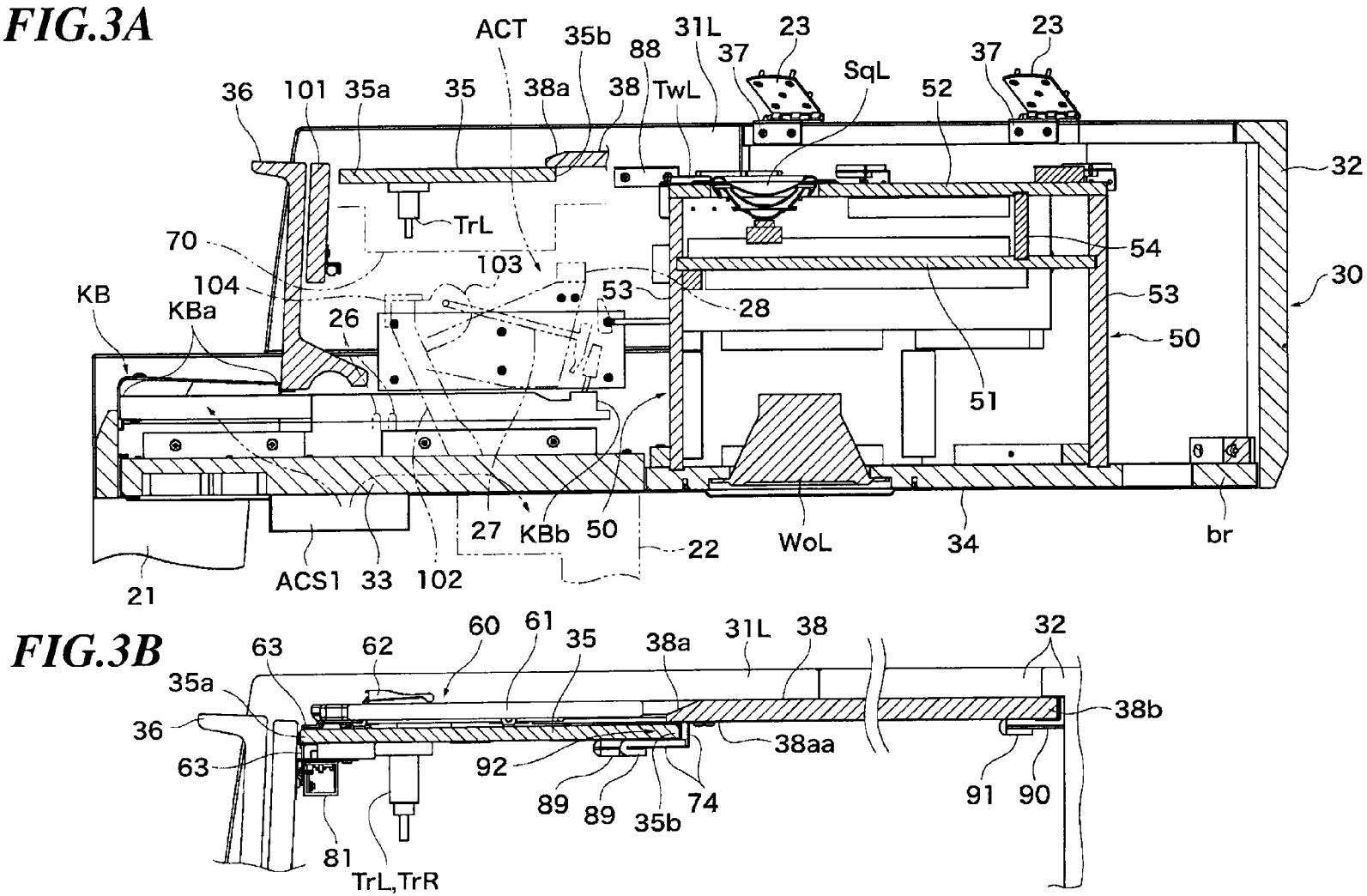
FIG. 3A is a section view showing an instrument main body of the electronic keyboard instrument taken along line A-A in FIG. 1B.
FIG. 3B is a fragmentary section view showing an upper part of the instrument main body taken along line B-B in FIG. 1B.

FIG. 2 shows the keyboard instrument 100 in bottom view, and FIGS. 3A and 3B show in section view an instrument main body 30 of the keyboard instrument 100 taken along line A-A in FIG. 1B and an upper part of the instrument main body 30 taken along line B-B in FIG. 1B. Illustrations of some constituent elements are omitted in FIGS. 3A and 3B.

As shown in FIGS. 1A and 2, the instrument main body 30 is supported by three legs 21. In the following, the terms "vertical direction", "left-right direction" and "front-rear direction" refer to directions as viewed from a player in front of the keyboard instrument 100 placed on a floor.

As shown in FIGS. 2 and 3A, a bottom part of the instrument main body 30 is constituted by front and rear keybeds 33, 34. Left-hand and right-hand side plates 31L, 31R are provided so as to vertically extend from left and right edges br of front and rear keybeds 33, 34, and a curved back plate 32 is provided so as to vertically extend from a curved outer peripheral edge br of the rear keybed 34. A front plate 101 is disposed to bridge the side plates 31L, 31R. The fallboard 36 in an open state extends nearly parallel to the front plate 101.

The instrument main body 30 comprised of the front plate 101, side plates 31L, 31R, back plate 32, and front and rear keybeds 33, 34 is similar in planar shape to a grand piano. The keyboard KB is disposed at the frontmost part of the instrument main body 30 between the side plates 31L, 31R. A pedal unit 22 has a lower end thereof provided with a pedal PD, and is pendent from the front keybed 33 (see FIG. 1A). The keyboard KB is disposed on the front keybed 33 via a support member, e.g., a spacer or a key frame, not shown.

As shown in FIG. 3A, the keyboard KB has a seesaw type white and black keys, which are pivotable about pins 26. A key-depression part KBa of the keyboard KB (visible parts of the white and black keys) is depressed for musical performance. A hammer action mechanism ACT having hammers 27 for the keys is disposed rearward of the key-depression part KBa and upward of a rear end portion KBb of the keyboard KB. The keyboard KB and the hammer action mechanism ACT are similar in basic construction to those of an acoustic grand piano.

A plurality of support pillars 102 are vertically provided on the front keybed 33 and spaced from one another at an appropriate distance in the left-right direction. A bridging bar 104 is fixed to upper ends of the support pillars 102 and has left and right ends fixed to the side plates 31L, 31R, whereby the support pillars 102 are reinforced. The support pillars 102 have base portions 103 that pivotably support the hammers 27.

As shown in FIGS. 1B and 3A, two mounting fittings 37 (e.g., metal fittings) are provided at an upper end of the left half of the back plate 32. The roof plate 25 is mounted to the mounting fittings 37 by roof plate attachment fittings 23 with hinges so as to be openable and closable relative to the back plate 32. An open state of the roof plate 25 is maintained by a support rod 24 (see FIG. 1A).

As shown in FIGS. 1B and 3B, an upper part of the instrument main body 30 is constituted by a front soundboard 35 and an intermediate plate 38. The intermediate plate 38 is disposed rearward of the soundboard 35 and similar in planar shape to a grand piano soundboard. The soundboard 35 has a front end portion 35*a* straightly extending in the left-right direction and a rear end portion 35*b* formed into an arch shape which is convex rearward. Soundboard attachment fittings 74 (see FIG. 3B) are mounted to a front end portion 38*a* of the intermediate plate 38. Recesses complementary to the rear end portion 35*b* of the soundboard 35 are defined by the front end portion 38*a* of the intermediate plate 38 and the soundboard attachment fittings 74.

As shown in FIG. 1B, a music stand device 60 is disposed at the center in the left-right directions right above the soundboard 35, and lamp stands 39L, 39R are disposed on the left and right sides of the music stand device 60 right above left and right end portions of the soundboard 35.

The intermediate plate 38 is fixed to the side plates 31L, 31R and the back plate 32. The soundboard 35 is fixed to a front bar 81 (described later) fixed to the side plates 31L, 31R, and is also fixed to the intermediate plate 38. The music stand device 60 and the lamp stands 39L, 39R are fixed to the front bar 81 and a rear bar 82 (described later). The rear bar 82 is fixed to the side plates 31L, 31R. The way of how the intermediate plate 38, soundboard 35, music stand device 60, and lamp stand 39 are fixed will be described in detail later.

Transducers TrL, TrR are disposed on a lower surface of the soundboard 35 (see FIGS. 1B, 3A and 3B). The transducers TrL, TrR are disposed between the lamp stands 39L, 39R and the music stand device 60 so as not to overlap the lamp stands 39L, 39R and the music stand device 60 as viewed in plan (see FIG. 1B). The transducers TrL, TrR are configured to vibrate (excite) the soundboard 35 in accordance with a supplied musical tone signal, thereby generating sound.

The front keybed 33 is disposed and configured to function as a soundboard. On a lower surface of the left half of the front keybed 33, there are disposed left and right vibration exciting units ACS1, ACS2 (see FIGS. 2 and 3A) each having a transducer and configured to vibrate (excite) the front keybed 33 for sound generation. Vibrations of the vibration exciting units ACS1, ACS2 are conveyed toward the keyboard KB and the pedal unit 22 as shown by arrows in FIG. 3A, and are perceived by the player's hands and feet. Since the keybed is divided into the front and rear keybeds 33, 34 and the vibration exciting unit ACS1, ACS2 are disposed on the front keybed 33, the keybed 33 as a soundboard can be vibrated with small energy, and the keyboard KB and a speaker box 50 (described below) can be mounted with ease.

As shown in FIG. 3A, the speaker box 50 is disposed on the rear half of the instrument main body 30 at a location rearward of the soundboard 35. A bottom part of the speaker box 50 is constituted by the rear keybed 34, and an upper part of the speaker box 50 is covered by the intermediate plate 38 (see FIG. 1B). As shown in FIG. 2, four woofers WoL, WoC, WoR, WoB (hereinafter collectively denoted by Wo), i.e., speakers for low pitch tones, are directed downward and disposed on a part of the rear keybed 34 corresponding to a lower part of the speaker box 50.

Four squawkers SqL, SqC, SqR, SqB (hereinafter collectively denoted by Sq), i.e., speakers for intermediate pitch tones, and four tweeters TwL, TwC, TwR, TwB (hereinafter collectively denoted by Tw), i.e., speakers for high pitch tones, are directed upward and disposed on an upper part of the speaker box 50 (mainly on the upper plate 52) so as to correspond to the woofers WoL, WoC, WoR, WoB. As shown in FIG. 1B, the squawkers Sq and the tweeters Tw are exposed for sound emission via corresponding through holes formed in the intermediate plate 38.

The squawkers Sq and the tweeters Tw are therefore directed opposite from the woofers Wo. As shown in FIG. 2, the squawker SqL, SqC, SqR, SqB are disposed close to the woofers WoL, WoC, WoR, WoB so as to partly overlap the woofers as viewed in plan view and bottom view. The transducers TrL, TrR are located at nearly the same positions as the squawkers SqL, SqR in the left-right direction (see FIG. 1B).

A horizontal partition plate 51 is disposed at a vertically intermediate or upper part of the speaker box 50 (see FIG. 3A), whereby a space inside the speaker box is divided into lower and upper spaces. Although not illustrated, the space below the partition plate 51 is divided into four spaces for the four woofers Wo, and the space above the partition plate 51 is divided into four space for the four squawkers Sq.

Figure 4:
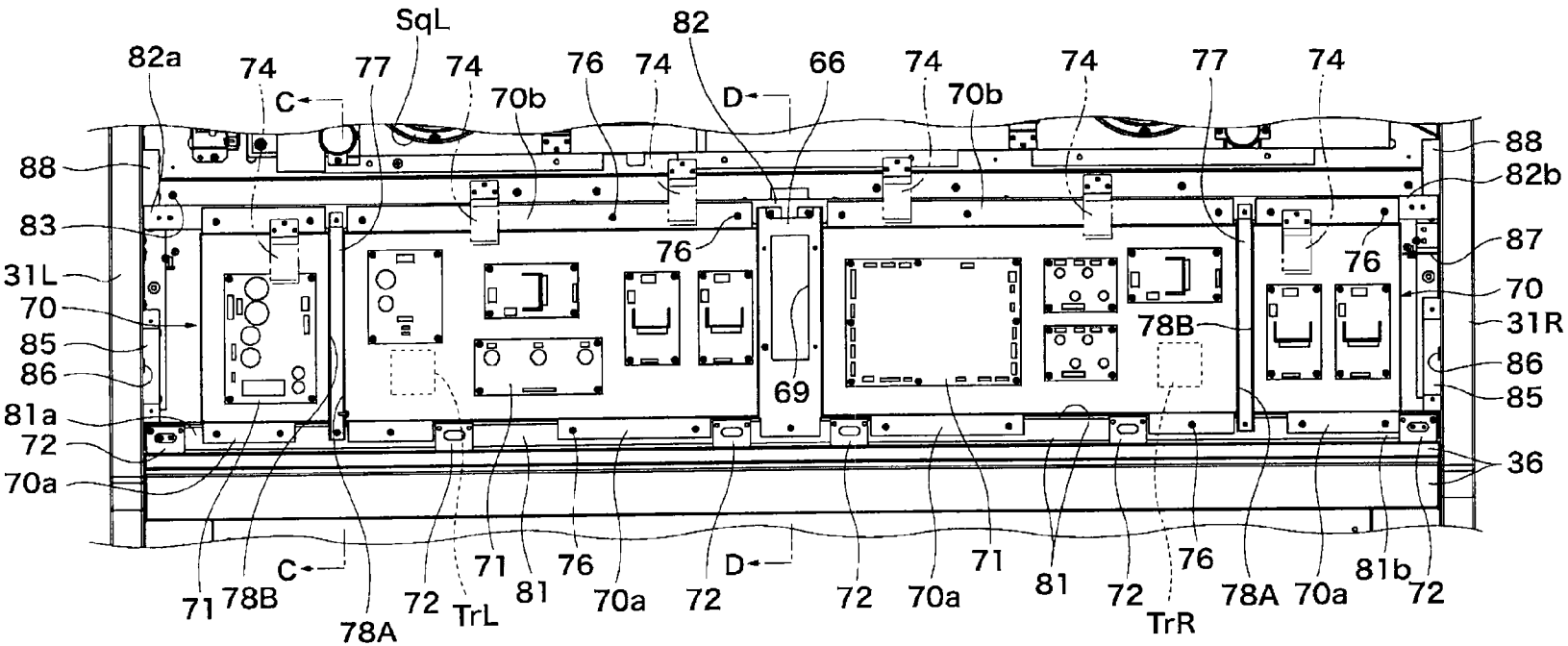
FIG. 4 is plane view showing a soundboard mounting part of the instrument main body in a state that a soundboard is detached therefrom.
Figure 5A:
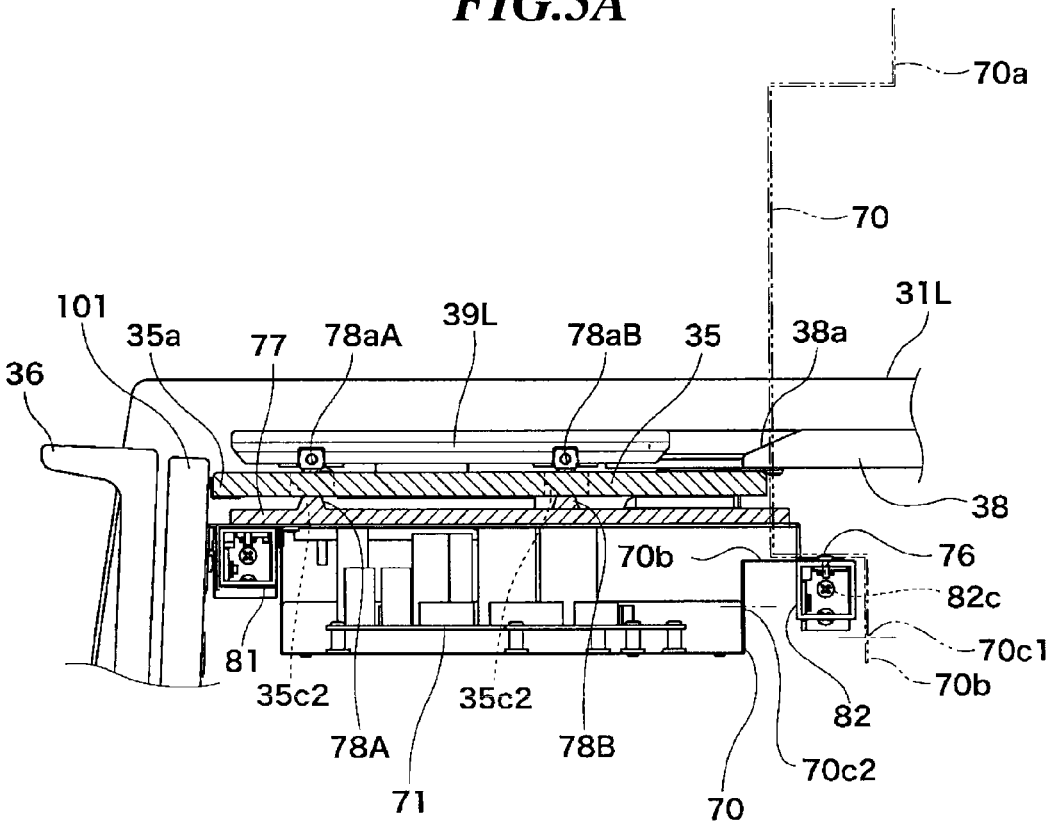
FIG. 5A is a fragmentary section view showing an upper part of the instrument main body taken along line C-C in FIG. 4.
Figure 5B:
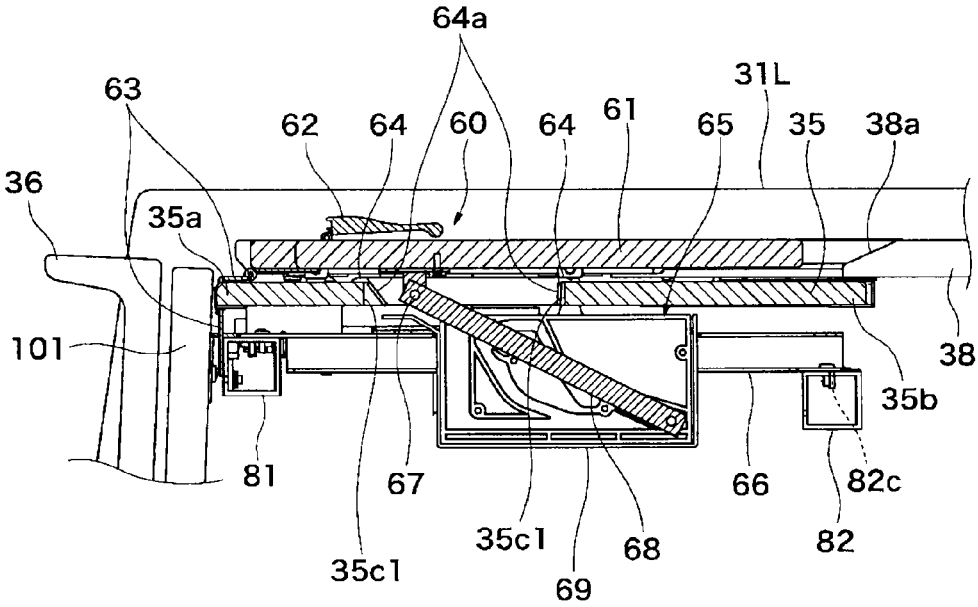
FIG. 5B is a fragmentary section view showing the upper part of the instrument main body taken along line D-D in FIG. 4.
Figure 6:
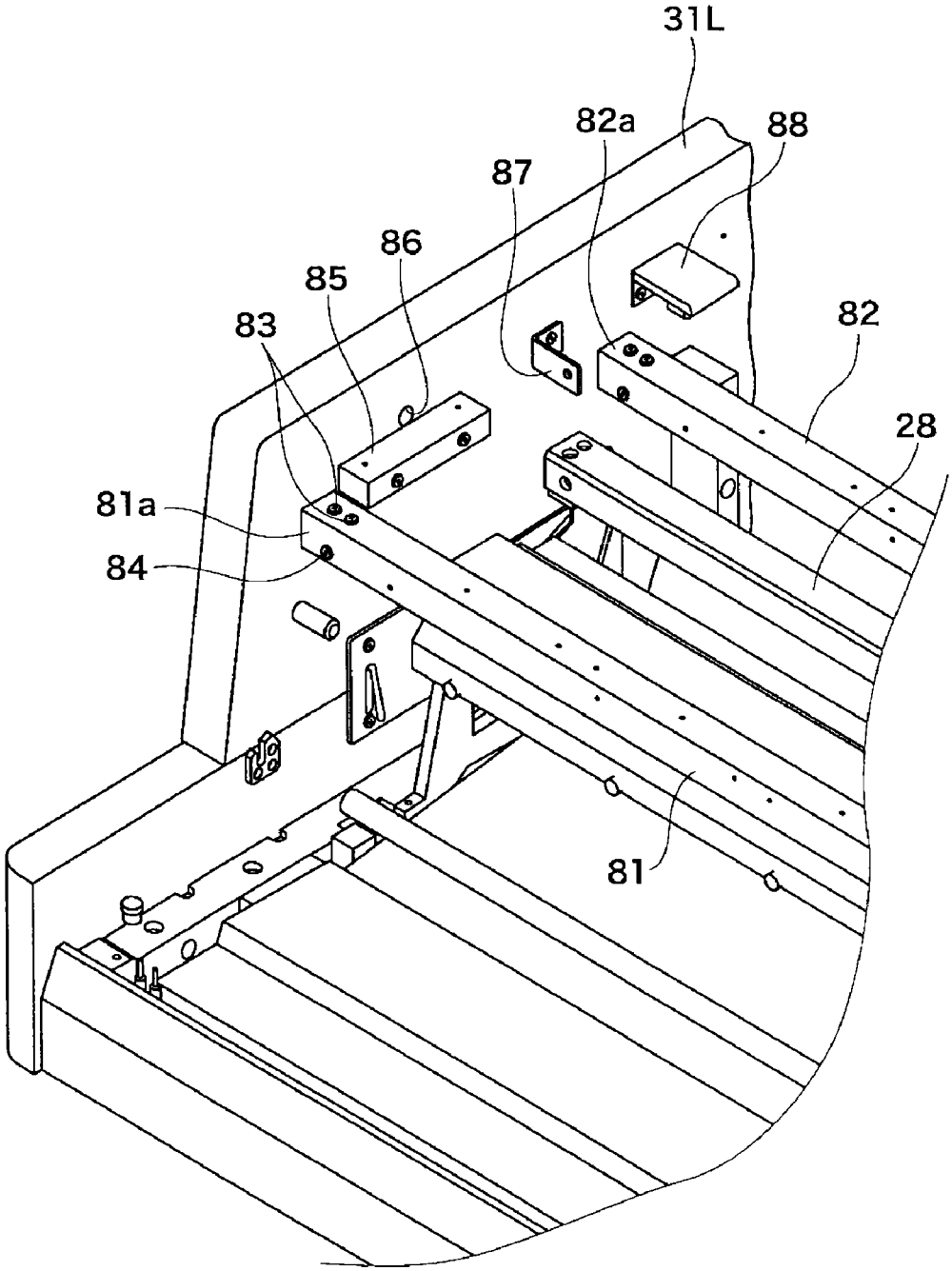
FIG. 6 is a fragmentary perspective view showing the interior of a left side portion of a front half of the instrument main body.

FIG. 4 shows in plan view a soundboard mounting part of the instrument main body 30 in a state where the soundboard 35 is detached from the soundboard mounting part. FIGS. 5A and 5B show in section an upper part of the instrument main body 30 taken along lines C-C and D-D in FIG. 4, with illustrations of some constituent elements omitted. FIG. 6 shows in perspective view the interior of the left side of the front half of the instrument main body 30 in a state that the soundboard 35, intermediate plate 38, music stand device 60, lamp stand 39, board tray 70 (described later), etc. are detached from the main body 30.

As shown in FIG. 4, front and rear bars 81, 82 made of metal or other rigid material are bridged between the side plates 31L, 31R and extend parallel to each other in the left-right direction. The front and rear bars 81, 82 function as a reinforcement to reinforce the instrument main body 30, and also function as an intermediate via which various constituent elements are fixed to the instrument main body 30.

The rear bar 82 is located rearward and slightly downward of the front bar 81 (see FIGS. 5A and 5B). As shown in FIG. 6, a left end portion 81*a* of the front bar 81 is fitted on and fastened by screws 83, 84 to an attachment fitting (not shown) provided on an inner surface of the side plate 31L, and is thereby fixed to the side plate 31L. Similarly, a left end portion 82*a* of the rear bar 82 is fixed to the side plate 31L. Right end portions 81*b*, 82*b* of the front and rear bars 81, 82 are similarly fixed to the side plate 31R (see FIG. 4). The front and rear bars 81, 82 can be fixed to the instrument main body 30 in any appropriate way.

As shown in FIGS. 4 and 6, lamp stand supports 85 are attached to the side plates 31L, 31R at locations rearward of the front bar 81, and positioning holes 86 are formed in the side plates 31L, 31R at locations right above the lamp stand supports 85. L-shaped intermediate plate fixture fittings 87 are attached to the side plates 31L, 31R at locations rearward of the lamp stand supports 85 and forward and upward of the rear bar 82. Intermediate plate temporal supports 88 are attached to the side plates 31L, 31R at locations rearward and upward of the rear bar 82 (see FIG. 3A as well).

A sensor mounting bar 28 is disposed right above the hammer action mechanism ACT (see FIG. 3A), and extends in the left-right direction so as to bridge the side plates 31L, 31R (see FIG. 6). The sensor mounting bar 28 is attached with key-depression sensors (not shown) each for optically detecting the action of a corresponding one of the hammers 27 to indirectly detect the action of a corresponding key.

As shown in FIG. 3B, metal fittings 90 are attached to an inner surface of the back plate 32, and forwardly projecting portions of the metal fittings 90 are covered by elastic members 91 (e.g., rubber members). A rear edge portion 38*b* of the intermediate plate 38 is press-fitted into recesses defined by the metal fittings 90 and the back plate 32. Left and right ends of the front end portion 38*a* of the intermediate plate 38 are fixed by screws to the intermediate plate fixture fittings 87 (see FIGS. 4 and 6). To mount the intermediate plate 38 onto the instrument main body 30, the intermediate plate 38 is placed on the intermediate plate provisional supports 88 and slid rearward to fit the rear edge portion 38*b* of the plate 38 into the metal fittings 90, and the left and right ends of the front end portion 38*a* of the intermediate plate 38 are fixed by the screws to the intermediate plate fixture fittings 87, as previously described. The intermediate plate 38 also has a function of hiding the interior of the instrument main body 30 (such as the speaker box 50) and reinforcing the main body 30.

As shown in FIG. 3B, soundboard attachment fittings 74 are attached by screws at plural places (e.g., six places) on an lower surface 38*aa* of the front end portion 38*a* of the intermediate plate 38. As with the metal fittings 90, the soundboard attachment fittings 74 each have a forwardly projecting portion that cooperates with the lower surface 38*aa* of the intermediate plate 38 to define a recess 92 that opens forwardly. The forwardly projecting portion of each attachment fitting 74 is covered by an elastic member 89 (e.g., rubber member). Soundboard fixture fittings 72 are fixed by screws at plural places (e.g., six places) onto an upper surface of the front bar 81 (see FIG. 4).

The rear end portion 35*b* of the soundboard 35 is press-fitted into the recesses 92 defined between the lower surface 38*aa* of the front end portion 38*a* of the intermediate plate 38 and the soundboard attachment fittings 74, and is in contact with the soundboard attachment fittings 74 via the elastic members 89. Thus, the soundboard 35 is held in a state ready for vibration. Since the rear end portion 35*b* of the soundboard 35 is hidden by the intermediate plate 38, the external appearance is improved. The front end portion 35*a* of the soundboard 35 is fixed to the soundboard fixture fittings 72.

To mount the soundboard 35 onto the instrument main body 30, the front end portion 35*a* of the soundboard 35 is placed on the soundboard fixture fittings 72. Then, the soundboard 35 is slid rearward and the rear end portion 35*b* is press-fitted into the recesses 92. Subsequently, metal fittings (not shown) attached to the front end portion 35*a* are fixed by screws to the soundboard fixture fittings 72.

As shown in FIGS. 4 and 5A, a board tray 70 is disposed to bridge the front and rear bars 81, 82, and includes a tray body formed into a U-shape that opens upward in side view and front and rear flanges 70*a*, 70*b* extending forwardly and rearwardly from the tray body. A plurality of circuit boards 71 are disposed on a bottom surface of the tray body. Some of the circuit boards 71 have a function for performing a process for electronically generating musical tones. The board tray 70 and the circuit boards 71 are disposed at locations upward of the hammer action mechanism ACT (see FIG. 3A) for easy maintenance and for effective space utilization. The soundboard 35 is smaller and lighter than an acoustic grand piano soundboard and can easily be mounted and dismounted. By detaching the soundboard 35, it becomes easy to carry out work on the circuit boards 71.

As shown in FIG. 4, the board tray 70 integrally formed by metal or other rigid material has a left-right direction length slightly smaller than the distance between the side plates 31L, 31R. The front flange 70*a* is segmented into plural portions as viewed in the left-right direction so as to avoid mounting positions of a music stand supporting bridge 66 (described later), two lamp stand supporting bridges 77 (described later), and the soundboard fixture fittings 72. Similarly, the rear flange 70*b* is segmented into plural portions to avoid the mounting positions of the music stand supporting bridge 66 and the lamp stand supporting bridges 77.

The front and rear flanges 70*a*, 70*b* are fastened by screws 76 to upper surfaces of the front and rear bars 81, 82, whereby the board tray 70 is fixed to the bars 81, 82. Specifically, the rear flange 70*b* is fixed to the rear bar 82 by threadedly engaging the screws 76 with fastening holes 82*c* of the rear bar 82 via fastening holes 70*c*1 (see FIG. 5A). Similarly, the front flange 70*a* is fixed to the front bar 81.

Fastening holes 70*c*2 are formed in a rear vertical portion of the board tray 70, which is adjacent to the rear flange 70*b* (see FIG. 5A). In a state where the board tray 70 is raised as shown by an imaginary line in FIG. 5A such that the front and rear flanges 70*a*, 70*b* are positioned on the upper and lower sides, the rear flange 70*b* of the board tray 70 is fixed to the rear bar 82 by threadedly engaging the screws 76 with the fastening holes 82*c* of the rear bar 82 via the fastening holes 70*c*2. As a result, it becomes easy to perform maintenance inside the instrument main body 30 below the board tray 70. Since the fastening holes 82*c* and the screws 76 can be used both when the board tray 70 is normally horizontally disposed and when it is vertically raised for maintenance, the construction does not become complicated. It should be noted that the music stand supporting bridge 66 and the lamp stand supporting bridges 77 must be detached before the board tray 70 is changed in posture between the vertically raised state and the normal horizontally disposed state.

Since the soundboard 35 is disposed to cover the board tray 70 and the circuit boards 71 from above, the space above the circuit boards 71 can effectively be utilized and the soundboard 35 is able to function as a lid for covering the circuit boards 71.

As shown in FIGS. 4 and 5A, the two lamp stand supporting bridges 77 made of, e.g., metal are disposed to bridge the front and rear bars 81, 82. The left and right lamp stand supporting bridges 77 for fixing the lamp stands 39L, 39R to the front and rear bars 81, 82 are the same in construction and disposed symmetrically with each other. In the following, the construction of the left lamp stand supporting bridge 77 and the way of how the lamp stand 39L is fixed to the bars 81, 82 are described as an example.

The left lamp stand supporting bridge 77 is elongated in the front-rear direction, and has left and right edges which are bent upward. A projection 78A is formed at a front portion of the right edge to project upward, and a projection 78B is formed at a rear portion of the left edge to project upward. Fastening holes 78*a*A, 78*a*B are formed in upper ends of the projections 78A, 78B to extend therethrough in the left-right direction (see FIG. 5A).

The soundboard 35 is formed with through holes 35*c*2 (run-off portions) at positions corresponding to the projections 78A, 78B (see FIGS. 1B and 5A). The projections 78A, 78B of the lamp stand supporting bridge 77 extend through the through holes 35*c*2 of the soundboard 35. The fastening holes 78*a*A, 78*a*B are located above the soundboard 35. Metal fittings are attached to a right end surface of the lamp stand 39L and are formed with holes in alignment with the fastening holes 78*a*A, 78*a*B. The lamp stand 39L is fixed to the projections 78A, 78B by engaging screws the with the fastening holes 78*a*A, 78*a*B via the holes of the metal fittings.

To mount the lamp stand 39L on the left lamp stand supporting bridge 77, the soundboard 35 is disposed and the lamp stand 39L is placed on the lamp stand support 85 (see FIGS. 4 and 6). Next, the lamp stand 39L is moved toward the side plate 31L to cause a positioning pin (not shown) formed on the left end surface of the lamp stand 39L to be fitted into the positioning hole 86 of the side plate 31L, thereby restricting the position of the lamp stand 39L in the front-rear and vertical directions. Then, the lamp stand 39L is fastened to the projections 78A, 78B of the left lamp stand supporting bridge 77 as previously described, thereby disposing the lamp stand 39L on the left lamp stand supporting bridge 77 so as to be out of contact with the soundboard 35 but close to an upper surface of the soundboard 35 (see FIG. 5A). Specifically, the lamp stand 39L is fixed to the projections 78A, 78B fixed to and projecting from the left lamp stand supporting bridge 77 which is fixed to the bars 81, 82 fixed to the instrument main body 30 (side plate 31L). Therefore, the lamp stand 39L is always in a state where the lamp stand is out of contact with the soundboard 35, and is fixed to the instrument main body 30 in that state.

Similarly, the lamp stand 39R is mounted on the right lamp stand supporting bridge 77. Thus, the lamp stands 39L, 39R can be mounted on the bars 81, 82 via the lamp stand supporting bridges 77 such that the soundboard 35 is not in contact with the lamp stands 39L, 39R and the lamp stand supporting bridges 77, and therefore the soundboard 35 is not hindered from vibrating.

The soundboard 35 is disposed such that the upper surface of the soundboard is located close to the lower surface 38*aa* of the intermediate plate 38 (see FIG. 3B). Thus, a vertical step difference is formed by the intermediate plate 38 and the soundboard 35 disposed vertically lower than the intermediate plate 38, and the lamp stands 39L, 39R are disposed in the vertical step difference. Accordingly, the lamp stands 39L, 39R can be mounted, while effectively utilizing the space above the soundboard 35, whereby the musical instrument height can be suppressed. Further, the upper surfaces of the lamp stands 39L, 39R are flush with the upper surface of the intermediate plate 38 (see FIG. 5A), and therefore the external appearance can be improved.

As shown in FIGS. 4 and 5B, the music stand supporting bridge 66 made of, e.g., metal is disposed to bridge the front and rear bars 81, 82. Front and rear end portions of the supporting bridge 66 are fixed to intermediate portions, as seen in the left-right direction, of the front and rear bars 81, 82. A box-like storage container 69 is mounted on an intermediate portion in the front-rear direction of the music stand supporting bridge 66, and a music stand raising device 65 is disposed inside the storage container 69.

As shown in FIG. 4, the transducers TrL, TrR are each disposed between adjacent soundboard attachment fittings 74 as viewed in plan view, and do not overlap the attachment fittings 74 in position in the left-right direction, whereby the soundboard 35 is easy to vibrate.

As shown in FIG. 5B, the music stand device 60 supported by the music stand supporting bridge 66 has a musical score plate 61, a musical score resting member 62, and the music stand raising device 65. A front upper end of a support rod 68 of the music stand raising device 65 is pivotably fixed to a rear surface of the musical score plate 61, which is located on the lower side when the plate 61 is in the fallen state, and a rear lower end of the support rod 68 is engaged with a guide groove formed in the music stand raising device 65.

A front end portion of the musical score plate 61 in the fallen state is attached to one of hinge pieces of a hinge 63, and another hinge piece of the hinge 63 extends downward and passes through a run-off part formed in a front end portion 35*a* of the soundboard 35, whereby the musical score plate 61 is pivotable in the front-rear and vertical directions (see FIG. 1B as well). The musical score plate 61 is supported via the support rod 68 by the storage container 69. In the fallen state, the musical score plate 61 is disposed parallel to and close to the upper surface of the soundboard 35.

In FIGS. 1B and 5B, when the musical score plate 61 in the fallen state is pivoted in a raising direction by the music stand raising device 65, the lower rear end of the support rod 68 is moved along the guide groove of the music stand raising device 65. When the musical score plate 61 pivoted to an appropriate raise angle is reversely pivoted in a falling direction, the lower rear end of the support rod 68 is brought in engagement with a stopper provided in the middle of the guide groove, whereby the musical score plate 61 is maintained in a raising state. Subsequently, when the musical score plate 61 is slightly pivoted to the raising direction and then pivoted to the falling direction, the engagement between the stopper and the support rod 68 is released, whereby the musical score plate 61 is returned to the fallen state.

The storage container 69 is disposed downward of the soundboard 35, and the musical score plate 61 is connected to the support rod 68 of the music stand raising device 65. As shown in FIG. 5B, the soundboard 35 is formed with a through hole 35*c*1 in which the support rod 68 can be displaced (see FIG. 1B as well). An annular rubber member 64 is disposed in the through hole 35*c*1, and the support rod 68 extends through an inner hollow 64*a* of the annular rubber member 64. The rubber member 64 does not interfere with the support rod 68 during the entire process in which the musical score plate 61 is fallen and raised, whereby the music stand device 60 can be disposed without hindering the soundboard 35 from vibrating.

In the fallen state, the musical score plate 61 of the music stand device 60 is located above the soundboard 35 in the vertical step difference formed by the intermediate plate 38 and the soundboard 35, thus making it possible to dispose the music stand device 60 by effectively utilizing the space above the soundboard 35, whereby the height of the musical instrument is suppressed. In addition, the upper surface of the music stand device 60 in the fallen state is flush with the upper surface of the intermediate plate 38 to improve the external appearance.

The above-described primary constituents are mounted on the bars 81, 82 in the following order. First, the board tray 70 is mounted, and then the music stand supporting bridge 66 and the lamp stand supporting bridges 77 are mounted. Next, the soundboard 35 is mounted, and then the lamp stands 39L, 39R and the music stand device 60 are mounted.

It should be noted that the constructions of the above described fastening parts are not limitative. A combination of fastening parts and fasteners is not limited to a combination of fastening holes and screws. A large number of through holes can be formed in the musical score plate 61 and the lamp stands 39L, 39R to enhance the sound emission efficiency.

Figure 7:
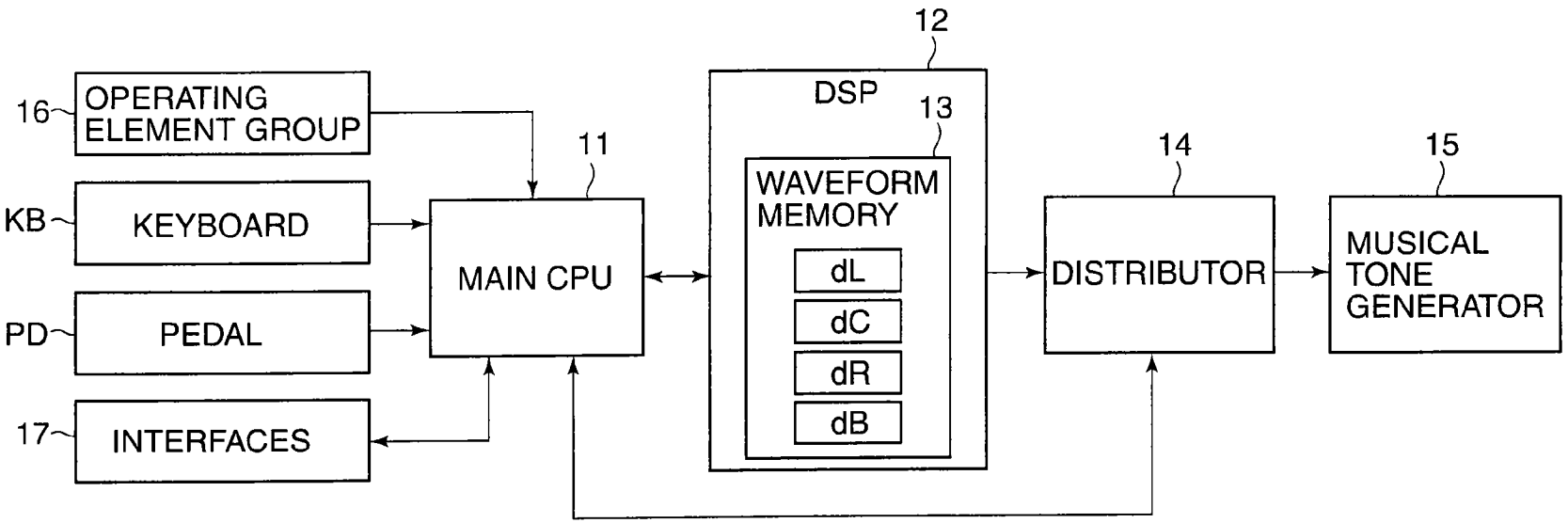
FIG. 7 is a block diagram showing the functional construction of the electronic keyboard instrument.

FIG. 7 shows in block diagram the functional construction of the electronic keyboard instrument 100. The keyboard instrument 100 includes a main CPU 11 to which the keyboard KB, operating element group 16, pedal PD, interfaces 17, DSP 12, and distributor 14 are connected. A musical tone generator 15 is connected to the distributor 14. The main CPU 11, the DSP 12, and the distributor 14 are mounted on the circuit boards 71 for generating electronic musical tones.

Information representing key manipulations on the keyboard KB is detected by key-depression sensors (not shown) mounted on the sensor mounting bar 28. Manipulation states of the operating element group 16 and the pedal PD are detected by manipulation detecting units (not shown). These pieces of detection information are supplied to the main CPU 11 and the DSP 12.

The operating element group 16 includes various operating elements such as a master volume operating element, effect operating element, and equipment setting operating element. The interfaces include, e.g., a MIDI interface and a wired or wireless communication interface. The main CPU 11 includes a ROM, a RAM, a timer, etc. (none of which are shown). The DSP 12 includes a CPU (not shown), a storage unit (not shown), and a waveform memory 13 in which waveform data groups dL, dC, dR, dB are stored in advance. The tone generator 15 includes the woofers Wo, squawkers Sq, tweeters Tw, transducers TrL, TrR, vibration exciting unit ACS1, ACS2, and amplifiers (not shown).

Each of the waveform data groups dL, dC, dR, dB is a set of pieces of sample waveform data. Each piece of sample waveform data, which is data for one sounding, has a volume envelope and is obtained by sampling a musical tone waveform of, e.g., a grand piano. For example, the musical tone waveforms on which the waveform data groups dL, dC, dR, dB are based are obtained from musical tones of an acoustic grand piano recorded at positions corresponding to the four squawkers Sq.

Each of the waveform data groups dL, dC, dR, dB is provided for every tone pitch (key) and for each of plural stages (e.g., eight stages) of key depression velocity. Instead of for every tone pitch, each waveform data group can be provided for every tone pitch range. In a case that the musical tone generator 15 is able to sound plural types of tone colors, each of the waveform data groups dL, dC, dR, dB can be provided for every tone color. Further, each waveform data group can be provided for each of stages (e.g., two or three stages) of pedal PD depression depth.

The waveform data groups dL, dC, dR, dB are for use in sound generation by the woofers Wo, squawkers Sq, and tweeters Tw. The waveform data groups dL, dC are also for use by the transducer TrL and the vibration exciting units ACS1, ACS2. The waveform data groups dC, dR are also for use by the transducer TrR. However, the correspondence relation between waveform data groups and sound generation, etc. is not limited to the above described relation.

When any of the keys of the keyboard KB is depressed, the DSP 12 selects, from each of the waveform data groups dL, dC, dR, dB, waveform data corresponding to the tone pitch of the depressed key and the stage to which a key depression velocity belongs, generates waveform signals based on the selected pieces of waveform data, and sends the generated waveform signals to the distributor 14.

The distributor 14 converts the sent waveform signals into analog musical tone signals, and supplies the musical tone signals to destinations determined in advance for every musical tone, among the woofers Wo, squawkers Sq, tweeters Tw, transducers TrL, TrR, and vibration exciting units ACS1, ACS2.

The woofers Wo and the soundboard 35 excited by the transducers TrL, TrR are assigned with different frequency bands. The center frequency of the frequency band assigned to the woofers WO is, e.g., 200 Hz which is lower than the center frequency (e.g., 2000 Hz) of the frequency band assigned to the soundboard 35.

According to this embodiment, the rear end portion 35*b* of the soundboard 35 is press-fitted into the recesses 92 defined between the front end portion 38*a* of the intermediate plate 38 and the soundboard attachment fittings 74. As for the rear end portion 35*b*, therefore, the soundboard 35 can easily be assembled to the instrument main body 30 by simply moving the soundboard 35 rearwardly. Since the rear end portion 35*b* of the soundboard 35 is in contact with the soundboard attachment fittings 74 via the elastic members 89, the soundboard 35 can be held in a state ready for vibration. Insofar as to easily mount the soundboard 35 in a state ready for vibration is concerned, it can be configured that instead of the rear end portion 35*b*, the front end portion 38*a* is press fitted, via an elastic member, to and held by a part (e.g., the front bar 81) stationary to the instrument main body 30.

According to this embodiment, since the board tray 70 for holding the circuit boards 71 for electronic musical tone generation is disposed above the hammer action mechanism ACT, the circuit boards 71 can be disposed at locations for easy maintenance and for effective space utilization.

Since the board tray 70 is disposed to bridge the front and rear bars 81, 82, the board tray 70 can achieve both the functions of holding the circuit boards 71 and reinforcing the bars 81, 82. Similarly, since the music stand supporting bridge 66 supporting the music stand device 60 and the lamp stand supporting bridges 77 supporting the lamp stands 39L, 39R are disposed to bridge the front and rear bars 81, 82, these supporting bridges 66, 77 can achieve both the functions of supporting the music stand device 60 and the lamp stands 39L, 39R and reinforcing the bars 81, 82.

According to this embodiment, the transducers TrL, TrR are disposed on the soundboard 35 at positions in which the transducers do not overlap the musical score plate 61 of the music stand device 60 and the lamp stands 39L, 39R in plan view (see FIG. 1B). As a result, a portion of the soundboard 35 having a large vibration amplitude is not hidden by the musical score plate 61 and the lamp stands 39L, 39R, and hence sounds emitted from the soundboard 35 are hardly hindered by the musical score plate 61 and the lamp stands 39L, 39R, whereby the efficiency of sound emission can be enhanced.

In particular, the musical score plate 61 of the music stand device 60 does not overlap the transducers TrL, TrR as viewed in plan in the entire process of falling and raising the musical score plate 61, including a raising state of the score plate 61. Thus, sound emitted from the soundboard 35 is hardly hindered by the musical score plate 61 both when the musical score plate 61 is in use and not in use.

Since the transducers TrL, TrR are located in the left-right direction at an intermediate position between the right end of the lamp stand 39L and the left end of the musical score plate 61 and at an intermediate position between the right end of the musical score plate 61 and the left end of the lamp stand 39R, the efficiency of sound emission can further be enhanced.

According to this embodiment, the hammer action mechanism ACT, circuit boards 71, lamp stand supporting bridges 77, and lamp stands 39L, 39R are disposed in a stacked state where they are disposed in this order from below, and are disposed within a vertical range from the front keybed 33 to the upper ends of the side plates 31L, 31R and the back plate 32. The hammer action mechanism ACT, front and rear bars 81, 82 (holding part), and circuit boards 71 are also disposed within the just-mentioned vertical range. With such a three-dimensional efficient installation structure, the keyboard instrument 100 can be made compact by effective space utilization.

It should be noted that it is enough to dispose the transducers TrL, TrR at positions to avoid the musical score plate 61 and the lamp stands 39L, 39R as viewed in plan view. The transducers TrL, TrR can be disposed on the side of the upper surface of the soundboard 35. In a case that the shape of the soundboard 35 is changed, the transducers TrL, TrR can be disposed frontward or rearward of the musical score plate 61.

Insofar as the construction for disposing the soundboard 35 such that a soundboard portion having a large vibration amplitude is located to avoid the musical score plate 61, etc. is concerned, the following modifications can be adopted.

Figure 8:
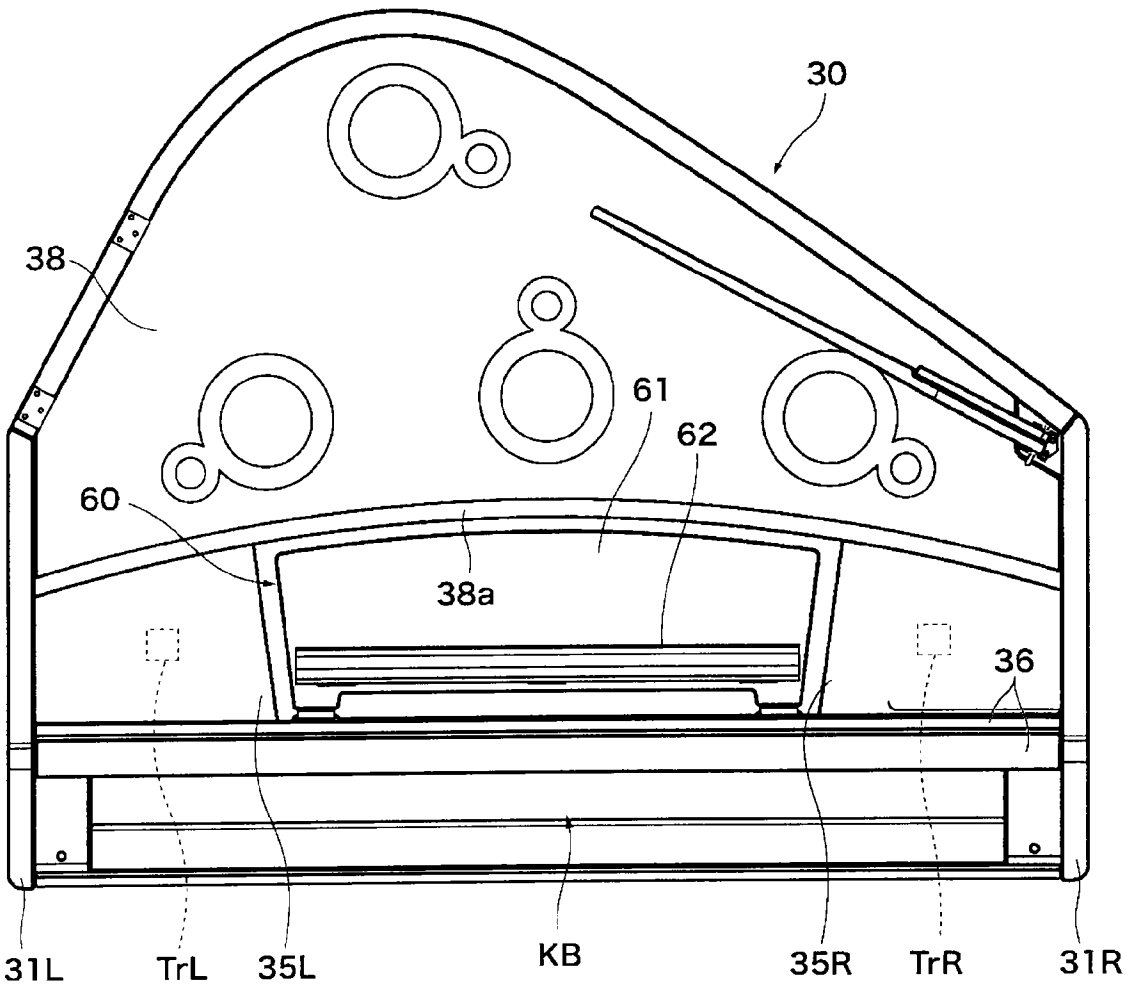
FIG. 8 is a plan view showing an electronic keyboard instrument according to a modification in a state that a roof plate is detached therefrom.

FIG. 8 shows in plan view the electronic keyboard instrument 100 according to a first modification in a state that the roof plate 25 is detached. In this modification, the lamp stands 39L, 39R are eliminated, and left and right soundboard 35L, 35R are separately provided in place of the soundboard 35. The soundboards 35L, 35R are disposed on the left and right sides of the musical score plate 61 of the music stand device 60, so as not to overlap the musical score plate 61 which is in the fallen state. The transducers TrL, TrR are disposed on lower surfaces of the soundboards 35L, 35R. In other respects, this modification is the same as the example shown in FIGS. 1A to 7.

With the first modification, the soundboards 35L, 35R are disposed at locations where they are not hidden by the musical score plate 61. Therefore, sound emission from the soundboards 35L, 35R are hardly hindered by the musical score plate 61, and sound emission efficiency can be enhanced.

It should be noted that in the first modification, only the soundboard 35L or 35R can be disposed on the left or right side of the musical score plate 61. Even in a case where the lamp stands 39L, 39R are provided, the same advantages can be achieved by disposing the soundboards 35L, 35R so as to avoid the musical score plate 61 and the lamp stands 39L, 39R as viewed in plan.

Insofar as the purpose of disposing the circuit boards 71 at locations for easy maintenance and for effective space utilization is concerned, the holding part for holding the circuit boards 71 is not limited to the front and rear bars 81, 82, but may be any part that is stationary relative to the instrument main body 30. The holding part can be fixed to the instrument main body 30 in various manners. For example, the front plate 101 can be used as the holding part and the circuit boards 71 can be held by the front plate 101. The circuit boards 71 can be directly or indirectly held by the holding part.

Figure 9:
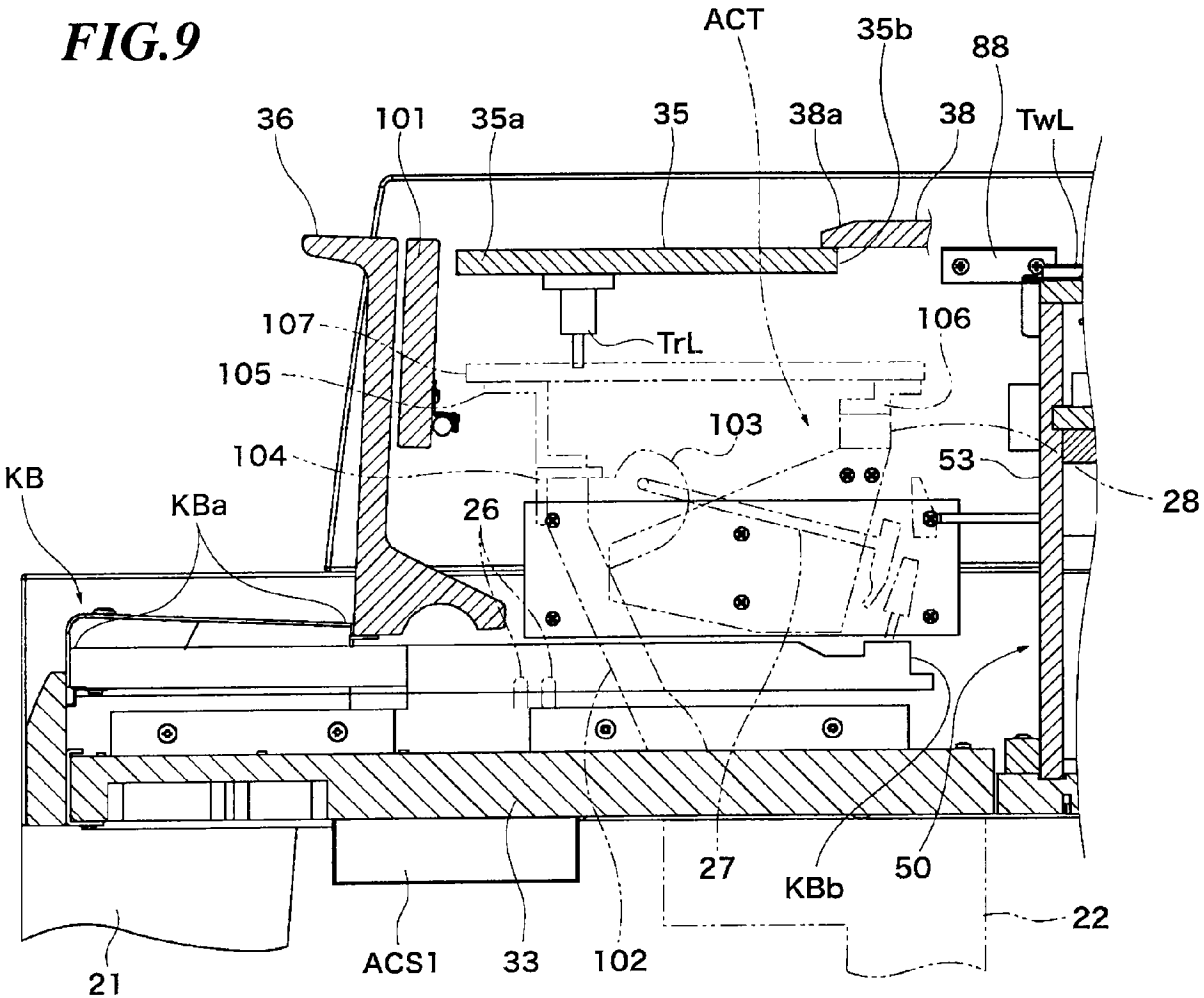
FIG. 9 is a fragmentary section view showing a front half of an instrument main body according to another modification.

As shown in a second modification in FIG. 9, a member alternative to the front and rear bars 81, 82 can be fixed to the instrument main body 30, and the circuit boards 71 can be held by the fixed member.

FIG. 9 shows in section view a front half of the instrument main body 30 according to the second modification. Front mounting members 105 are fixed onto the bridging bar 104, and rear mounting members 106 are fixed onto the sensor mounting bar 28. The front and rear mounting members 105, 106 are spaced at an appropriate distance from one another in the left-right direction. A second keybed 107 extending between the side plates 31L, 31R is horizontally disposed and fixed to the mounting members 105, 106. The circuit boards 71 are disposed and fixed to the second keybed 107 (although an illustration of how the circuit boards are disposed is omitted). In that case, the holding part is constituted by the front and rear mounting members 105, 106 (including the second keybed 107), and the circuit boards 71 can be directly or indirectly disposed on the holding part.

Like the bars 81, 82, the bridging bar 104 and the sensor mounting bar 28 have a function of reinforcing the instrument main body 30. The front and rear mounting members 105, 106 also function as wire clamps for use when wiring is performed between the keyboard KB and the circuit boards 71 and wiring is performed on the circuit boards 71.

In the construction in FIG. 9, the lamp stand supporting bridges 77 and the music stand supporting bridge 66 can be bridged between the bridging bar 104 and the sensor mounting bar 28, instead of being bridged between the bars 81, 82.

It should be noted that the waveform data groups dL, dC, dR, dB as a source of musical tone signals may not be stored in the electronic keyboard instrument 100, but can be read from an external device. The form of the source of musical tone signals is not limited to the form of the waveform data groups dL, dC, dR, dB.

It should be noted that musical tones can be generated not only by the depression of keys of the keyboard KB, but also based on automatic performance data, e.g., MIDI data, stored beforehand or externally input. In that case, waveform data is selected from each of the waveform data groups dL, dC, dR, dB in accordance with information on, e.g., tone pitch and key depression velocity in the automatic performance data read sequentially, and is processed as previously described.

What is claimed is:

1. An electronic keyboard instrument comprising:

an instrument main body;

a keyboard extending along a key-arrangement direction mounted to the instrument main body, the keyboard having a key-depression portion;

a music stand device having a musical score plate mounted to the instrument main body and disposed at a location rearward of the key-depression portion, the musical score plate being movable between an upright-use position and a stow position;

a soundboard mounted to the instrument main body and disposed below the musical score plate in the stow position and faces the musical score plate in the stow position;

a vibration unit mounted to the soundboard for vibrating the soundboard in accordance with a supplied musical tone signal to thereby produce sound; and a musical tone signal supply unit that supplies the musical tone signal to the vibration unit, wherein the vibration unit is disposed without overlapping with the musical score plate in the stow position along the key-arrangement direction of the keyboard.

2. The electronic keyboard instrument according to claim 1, further including:

a lamp stand mounted to the instrument main body and disposed at a location rearward of the key-depression and portion above the soundboard, wherein the vibration unit is disposed without overlapping with the lamp stand along the key-arrangement direction of the keyboard.

3. The electronic keyboard instrument according to claim 2, wherein the vibration unit is disposed between the music stand device and the lamp stand along the key-arrangement direction of the keyboard.

4. The electronic keyboard instrument according to claim 2, wherein the lamp stand is disposed without contacting the soundboard.

5. The electronic keyboard instrument according to claim 1, further including:

an intermediate plate mounted to the instrument main body and disposed extending rearward of the sound board; and a speaker assigned with a frequency band different from a frequency band assigned to the soundboard, wherein the speaker is mounted to the intermediate plate.

6. The electronic keyboard instrument according to claim 5, wherein the speaker is disposed at a location rearward of the music stand device.

7. An electronic keyboard instrument comprising:

an instrument main body;

a keyboard extending along a key-arrangement direction mounted to the instrument main body, the keyboard having a key-depression portion;

a music stand device having a musical score plate mounted to the instrument main body and disposed above the keyboard rearward of the key-depression portion, the musical score plate being movable between an upright-use position and a stow position;

a soundboard mounted to the instrument main body and disposed also above the keyboard rearward of the key-depression portion and at at least one of a left side or a right side of the musical score plate relative to the longitudinal direction of the keyboard;

a vibration unit mounted to the soundboard for vibrating the soundboard in accordance with a supplied musical tone signal to thereby produce sound; and a musical tone signal supply unit that supplies the musical tone signal to the vibration unit.

8. The electronic keyboard instrument according to claim 7, wherein the soundboard is disposed without overlapping the musical score plate in the stow position along the key-arrangement direction of the keyboard.

* * * * *